US010533316B1

(12) United States Patent
Robinson

(10) Patent No.: US 10,533,316 B1
(45) **Date of Patent: *Jan. 14, 2020**

(54) EXPANSION JOINT SYSTEM WITH FLEXIBLE SHEETING AND THREE LAYERS

(71) Applicant: Schul International Co., LLC, Pelham, NH (US)

(72) Inventor: Steven R. Robinson, Windham, NH (US)

(73) Assignee: Schul International Co., LLC, Hudson, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/386,461

(22) Filed: Apr. 17, 2019

Related U.S. Application Data

(63) Continuation of application No. 16/033,886, filed on Jul. 12, 2018, now Pat. No. 10,323,409.

(51) Int. Cl.
*E04B 1/68* (2006.01)
*E04B 1/94* (2006.01)
*E01C 11/12* (2006.01)

(52) U.S. Cl.
CPC ..... *E04B 1/6812* (2013.01); *E01C 11/126* (2013.01); *E04B 1/6801* (2013.01); *E04B 1/6815* (2013.01); *E04B 1/943* (2013.01); *E04B 1/947* (2013.01); *E04B 1/948* (2013.01)

(58) Field of Classification Search
CPC ..... E04B 1/6812; E04B 1/948; E04B 1/943; E04B 1/947; E04B 1/6815; E04B 1/6807; E04B 1/68; E04B 1/6801; E04B 2001/6818; E01C 11/10; E01C 11/106; E01C 11/12; E01C 11/126
See application file for complete search history.

(56) References Cited

U.S. PATENT DOCUMENTS 2,184,148 A * 12/1939 Malcom ..... E01C 11/02 404/55
2,240,787 A * 5/1941 Kinzer ..... E01C 11/12 404/47
4,181,711 A * 1/1980 Ohashi ..... E04B 1/6812 428/40.6
4,767,655 A * 8/1988 Tschudin-Mahrer ..... E04B 1/68 206/83.5
8,317,444 B1 11/2012 Hensley
8,341,908 B1 1/2013 Hensley et al.
8,365,495 B1 2/2013 Witherspoon
8,739,495 B1 6/2014 Witherspoon
8,813,449 B1 8/2014 Hensley et al.
(Continued)

*Primary Examiner* — Jessie T Fonseca
(74) *Attorney, Agent, or Firm* — Crain, Caton & James, P.C.; James E. Hudson, III

(57) ABSTRACT

The present disclosure relates generally to systems for providing a durable water-resistant and fire-resistant foam-based seal in the joint between adjacent panels. An expansion joint seal, which may be fire-resistant and/or water-resistant, is provided which includes one or more body members, a fire retardant member, which may be of an intumescent member, interspersed within the body member or members, a plurality of resilient members to provide a spring recovery force and fire resistance, and a connector of at least two of the resilient members, which connect each of the resilient members to a cover plant or may connect the two resilient members to one another.

6 Claims, 2 Drawing Sheets

(56) References Cited

U.S. PATENT DOCUMENTS

| | | | |
|---|---|---|---|
| 8,813,450 | B1 | 8/2014 | Hensley et al. |
| 8,870,506 | B2 | 10/2014 | Hensley et al. |
| 9,068,297 | B2 | 6/2015 | Hensley et al. |
| 9,200,437 | B1 | 12/2015 | Hensley et al. |
| 9,206,596 | B1 | 12/2015 | Robinson |
| 9,322,163 | B1 | 4/2016 | Hensley |
| 9,404,581 | B1 | 8/2016 | Robinson |
| 9,528,262 | B2 | 12/2016 | Witherspoon |
| 9,631,362 | B2 | 4/2017 | Hensley et al. |
| 9,637,915 | B1 | 5/2017 | Hensley et al. |
| 9,644,368 | B1 | 5/2017 | Witherspoon |
| 9,670,666 | B1 | 6/2017 | Witherspoon et al. |
| 9,689,157 | B1 | 6/2017 | Hensley et al. |
| 9,689,158 | B1 | 6/2017 | Hensley et al. |
| 9,739,049 | B1 | 8/2017 | Robinson |
| 9,739,050 | B1 | 8/2017 | Hensley et al. |
| 9,745,738 | B2 | 8/2017 | Robinson |
| 9,765,486 | B1 | 9/2017 | Robinson |
| 9,803,357 | B1 | 10/2017 | Robinson |
| 9,840,814 | B2 | 12/2017 | Robinson |
| 9,850,662 | B2 | 12/2017 | Hensley |
| 9,856,641 | B2 | 1/2018 | Robinson |
| 9,951,515 | B2 | 4/2018 | Robinson |
| 9,963,872 | B2 | 5/2018 | Hensley et al. |
| 9,982,428 | B2 | 5/2018 | Robinson |
| 9,982,429 | B2 | 5/2018 | Robinson |
| 9,995,036 | B1 | 6/2018 | Robinson |
| 10,000,921 | B1 | 6/2018 | Robinson |
| 10,060,122 | B2 | 8/2018 | Robinson |
| 10,066,386 | B2 | 9/2018 | Robinson |
| 10,066,387 | B2 | 9/2018 | Hensley et al. |
| 10,081,939 | B1 | 9/2018 | Robinson |
| 10,087,619 | B1 | 10/2018 | Robinson |
| 10,087,620 | B1 | 10/2018 | Robinson |
| 10,087,621 | B1 | 10/2018 | Robinson |
| 10,072,413 | B2 | 11/2018 | Hensley et al. |
| 10,125,490 | B2 | 11/2018 | Robinson |
| 10,179,993 | B2 | 1/2019 | Hensley et al. |
| 10,203,035 | B1 | 2/2019 | Robinson |
| 10,213,962 | B2 | 2/2019 | Robinson |
| 10,227,734 | B1 | 3/2019 | Robinson |
| 10,233,633 | B2 | 3/2019 | Robinson |
| 10,240,302 | B2 | 3/2019 | Robinson |
| 2014/0219719 | A1 | 8/2014 | Hensley et al. |
| 2014/0360118 | A1 | 12/2014 | Hensley et al. |
| 2015/0068139 | A1 | 3/2015 | Witherspoon |
| 2016/0208480 | A1* | 7/2016 | Hensley ..... E04B 1/6812 |
| 2017/0130450 | A1 | 5/2017 | Witherspoon |
| 2017/0159817 | A1 | 6/2017 | Robinson |
| 2017/0191256 | A1 | 7/2017 | Robinson |
| 2017/0226733 | A1 | 8/2017 | Hensley et al. |
| 2017/0241132 | A1 | 8/2017 | Witherspoon |
| 2017/0254027 | A1 | 9/2017 | Robinson |
| 2017/0268222 | A1 | 9/2017 | Witherspoon et al. |
| 2017/0292262 | A1 | 10/2017 | Hensley et al. |
| 2017/0298618 | A1 | 10/2017 | Hensley et al. |
| 2017/0314213 | A1 | 11/2017 | Robinson |
| 2017/0314258 | A1 | 11/2017 | Robinson |
| 2017/0342665 | A1 | 11/2017 | Robinson |
| 2017/0342708 | A1 | 11/2017 | Hensley et al. |
| 2017/0370094 | A1 | 12/2017 | Robinson |
| 2018/0002868 | A1 | 1/2018 | Robinson |
| 2018/0016784 | A1 | 1/2018 | Hensley et al. |
| 2018/0038095 | A1 | 2/2018 | Robinson |
| 2018/0106001 | A1 | 4/2018 | Robinison |
| 2018/0106032 | A1 | 4/2018 | Robinison |
| 2018/0119366 | A1 | 5/2018 | Robinison |
| 2018/0142465 | A1 | 5/2018 | Robinison |
| 2018/0148922 | A1 | 5/2018 | Robinison |
| 2018/0163394 | A1 | 6/2018 | Robinison |
| 2018/0171564 | A1 | 6/2018 | Robinison |
| 2018/0171625 | A1 | 6/2018 | Robinison |
| 2018/0202148 | A1 | 7/2018 | Hensley et al. |
| 2018/0238048 | A1 | 8/2018 | Robinison |
| 2018/0266103 | A1 | 9/2018 | Robinson |
| 2018/0274228 | A1 | 9/2018 | Robinson |
| 2018/0300490 | A1 | 10/2018 | Robinson |
| 2018/0363292 | A1 | 12/2018 | Robinson |
| 2018/0371746 | A1 | 12/2018 | Hensley et al. |
| 2018/0371747 | A1 | 12/2018 | Hensley et al. |
| 2019/0057215 | A1 | 2/2019 | Robinson |
| 2019/0063608 | A1 | 2/2019 | Robinson et al. |
| 2019/0071824 | A1 | 3/2019 | Robinson |
| 2019/0107201 | A1 | 4/2019 | Robinson |
| 2019/0108351 | A1 | 4/2019 | Robinson |

* cited by examiner

EXPANSION JOINT SYSTEM WITH FLEXIBLE SHEETING AND THREE LAYERS

CROSS-REFERENCE TO RELATED APPLICATIONS

This application is a continuation of U.S. patent application Ser. No. 16/033,886 for "Expansion joint system with flexible sheeting," filed Jul. 12, 2018, which is incorporated herein by reference, the priority to and the benefit of which are hereby claimed.

STATEMENT REGARDING FEDERALLY SPONSORED RESEARCH OR DEVELOPMENT

Not Applicable.

BACKGROUND

Field

The present disclosure relates generally to systems for creating a durable seal in the joint between adjacent panels. More particularly, the present disclosure is directed to providing an expansion joint seal system which includes a plurality of components to protect the adjacent substrates and joint.

Description of the Related Art

Construction panels come in many different sizes and shapes and may be used for various purposes, including roadways, sideways, tunnels and other construction and building structures. Where the construction panels are concrete, it is necessary to form a lateral gap or joint between adjacent panels to allow for independent movement, such in response to ambient temperature variations within standard operating ranges. These gaps are also used to permit moisture to be collected and expelled. Cavity walls are common in masonry construction, typically to allow for water or moisture to condense or accumulate in the cavity or space between the two exterior walls. Collecting and diverting moisture from the cavity wall construction can be accomplished by numerous well-known systems. The cavity wall is often ventilated, such as by brick vents, to allow air flow into the cavity wall and to allow the escape of moisture heat or humidity. In addition to thermal movement or seismic joints in masonry walls, control joints are often added to allow for the known dimensional changes in masonry over time. Curtain wall or rain screen design is another common form of exterior cladding similar to a masonry cavity wall. Curtain walls can be designed to be primarily watertight but can also allow for the collection and diversion of water to the exterior of the structure. A cavity wall or curtain wall design cannot function as intended if the water or moisture is allowed to accumulate or condense in the cavity wall or behind a curtain wall or rain screen design cannot be diverted or redirected back to the outside of the wall. If moisture is not effectively removed it can cause damage ranging from aesthetic in the form of white efflorescence buildup on surface to mold and major structural damage from freeze/thaw cycling.

Thus, expansion and movement joints are a necessary part of all areas of construction. The size and location of the movement depends on variables such as the amount of anticipated thermal expansion, load deflection and any expected seismic activity. Joint movement in a structure can be cyclical in design as in an expansion joint or in as a control joint to allow for the shrinkage of building components or structural settling. These movement joints serve an important function by allowing a properly designed structure to move and the joint to cycle over time and to allow for the expected dimensional changes without damaging the structure. Expansion, control and movement joints are found throughout a structure from the roof to the basement, and in transitions between horizontal and vertical planes. It is an important function of these expansion joints to not only move as intended but to remain in place through their useful lifespan. This is often accomplished by extending the length and/or width of the expansion joint system over or past the edge of the gap or joint opening to attach to the joint substrate or another building component. Examples of building components that would ideal to integrally join an expansion joint with and seal would be, although not limited to, waterproofing membranes, air barrier systems, roofing systems, deck coatings and transitions requiring the watertight diversion of rain water. Although these joints represent only a small percentage of the building surface area and initial cost, they often account for a large percentage of waterproofing, heat loss, moisture/mold problems and other serious interior and exterior damage during the life of the building.

Conventional joint sealants like gunnable sealants and most foam seals are designed to hold the water out of the structure or expansion joint. However, water can penetrate the joint substrate in many ways such as cracks, poor sealant installation, roofing details and a porous substrate or wall component. When water or moisture enters the wall the normal sealing function of joint sealant may undesirably retain the moisture in the wall. Foam joint seals known in the art typically rely on the application of an elastomer sealant on the primary or exposed face of foam to provide the water resistant function. Such joint seals are not waterproof, but retard the penetration of water into the joint by providing a seal between adjacent substrates for a time and under a maximum pressure. Particularly, such joint seals are not waterproof—they do not preclude water penetration under all circumstances. While this is helpful initially to keep water out of the joint and structure it does not allow for this penetrating water or moisture to escape.

Further complicating operation, some wall designs, such as cavity or curtain walls, allow for moisture to enter a first wall layer where it collects and is then directed to the outside of the building by flashing and weep holes. In these systems, water can sometimes be undesirably trapped in the cavity wall, such as at a mortar bridge in the wall, or other impediment caused by poor flashing selection, design or installation. When a cavity wall drainage system fails, water is retained within the structure, leading to moisture accumulating within in the wall, and to an efflorescence buildup on the exterior of the wall. This can also result in freeze-thaw damage, among other known problems.

To be effective in this environment, fully functional, foam-based joint seals require a minimum compression ratio and impregnation density. It is known that higher densities and ratios can provide addition sealing benefits. Cost, however, also tends to increase with overall density. There is ultimately a trade-off between compression ratio/density range and reasonable movement capabilities at about 750 $kg/m^3$. As can be appreciated, this compressed density is a product of the uncompressed density of the material and the desired compression ratio to obtain other benefits, such as water resistance. For example, a foam having an uncompressed density of 150 $kg/m^3$ uncompressed and compressed at a 5:1 ratio results in a compressed density of 750 kg/m$^3$. Alternative uncompressed densities and compression ratios may reach that compressed density of 750 kg/m$^3$ while producing different mechanical properties. It has been long known in the art that a functional foam expansion joint sealant can be constructed using an uncompressed impregnated foam density range of about 80 kg/m$^3$ at a 5:1 compression ratio, resulting in a compressed density of 400 kg/m$^3$. This functional foam expansion joint sealant is capable of maintaining position within a joint and its profile while accommodating thermal and seismic cycling, while providing effective sealing, resiliency and recovery. Such joint seals are not fireproof, but retard the penetration of fire into the joint by providing a seal which protects the adjacent substrates or the base of the joint for a time and under a maximum temperature. Particularly, such joint seals are not fireproof—they do not preclude the burning and decomposition of the foam when exposed to flame.

Another alternative known in the art for increasing performance is to provide a water resistant impregnated foam at a density in the range of 120-160 kg/m$^3$, ideally at 150 kg/m$^3$ for some products, with a mean joint size compression ratio of about 3:1 with a compressed density in a range of about 400-450 kg/m$^3$, although densities in a broader range, such as 45-710 kg/m$^3$ uncompressed and installed densities, after compression and installation in the joint, of 45 kg/m$^3$ and 1500 kg/m$^3$ may also be used by increasing the raw foam density and the density of the functional fillers such as those with a density greater than 0.3 kg/m$^3$. High density elastically compressible foams that still meet the same movement, water and fire resistance properties as those that cycle between 300-750 kg/m$^3$ represents an improvement in the art due the increased resistance to deflection, surface force resistance and the ability to be dimensional stable in depth to width ratios of less than 1:1. These criteria ensure excellent movement and cycling while providing for fire resistance according to DIN 4102-2 F120, meeting the Conditions of Allowance under UL 2079 for a two-hour endurance, for conventional depth, without loading, with one or more movement classifications, for a joint not greater than six inches and having a movement rating as great as 100%, without a hose stream test, and an ASTM E-84 test result with a Flame Spread of 0 and a Smoke Index of 5. This density range is well known in the art, whether it is achieved by lower impregnation density and higher foam compression or higher impregnation density and a lower compression ratio, as the average functional density required for an impregnated open cell foam to provide sealing and other functional properties while allowing for adequate joint movement up to +/−50% or greater. Foams having a higher uncompressed density may be used in conjunction with a lower compression ratio, but resiliency may be sacrificed. As the compressed density increases, the foam tends to retard water more effectively and provides an improved seal against the adjacent substrates. Additives that increase the hydrophobic properties or inexpensive fillers such as calcium carbonate, silica or alumina hydroxide provided in the foam can likewise be provided in a greater density and become more effective. Combustion modified foams such as a combustion modified flexible polyurethane foam, combustion modified ether foam, combustion modified high resilience foam or combustion modified Viscoelastic foam can be utilized in the preferred embodiments to add significant fire resistance to the impregnated foam seal or expansion joint without adding additional fire retardant additives. Foam that is inherently fire resistant or is modified when it manufactured to be combustion or fire-resistant reduces the cost of adding and binding a fire retardant into the foam. This method has been found to be advantageous in allowing fire resistance in foam seals configured in very high compression ratios such 10:1 and in ratios lower than 2:1.

By selecting the appropriate additional component, the type of foam, the uncompressed foam density and the compression ratio, the majority of the cell network will be sufficiently closed to impede the flow of water into or through the compressed foam seal thereby acting like a closed cell foam. Beneficially, an impregnated or infused open cell foam can be supplied to the end user in a pre-compressed state in rolls/reels or sticks that allows for an extended release time sufficient to install it into the joint gap. To further the sealing operation, additional components may be included. For example, additives may be fully or partially impregnated, infused or otherwise introduced into the foam such that at least some portion of the foam cells are effectively closed, or a hydrophobic or water resistant coating is applied. However, the availability of additional components may be restricted by the type of foam selected. Closed cell foams which are inherently impermeable for example, are often restricted to a lower joint movement range such as +/−25% rather than the +/−50% of open celled foams. Additionally, the use of closed cell foams restricts the method by which any additive or fillers can be added after manufacture. Functional features such as fire resistance to the Cellulosic time-temperature curve for two hours or greater can be however be achieved in a closed cell foam seal without impacting the movement or shear properties. Intumescent graphite powder added to a polyethylene (PE), ethylene vinyl (EVA) acetate or other closed cell foam during processing in a ratio of about 10% by weight has been found to be a highly effective in providing flexible and durable water and fire resistant foam seal. While intumescent graphite is preferred, other fire retardants added during the manufacture of the closed cell foam are anticipated and the ratio of known fire retardants, added to the formulation prior to creating the closed cell foam, is dependent on the required fire resistance and type of fire retardant. Open celled foams, however, present difficulties in providing water-resistance and typically require impregnation, infusion or other methods for introducing functional additives into the foam. The thickness of a foam core or sheet, its resiliency, and its porosity directly affect the extent of diffusion of the additive throughout the foam. The thicker the foam core or sheet, the lower its resiliency, and the lower its porosity, the greater the difficulty in introducing the additive. Moreover, even with each of these at optimum, the additive will likely not be equally distributed throughout the foam but will be at increased density at the inner or outer portions depending on the impregnation technique.

A known alternative or functional supplement to the use of various impregnation densities and compression ratios is the application of functional surface coatings such as water-resistant elastomers or fire-resistant intumescents, so that the impregnated foam merely serves as a "resilient backer". Almost any physical property available in a sealant or coating can be added to an already impregnated foam sealant layering the functional sealant or coating material. Examples would include but not limited to, fire ratings, waterproofing, color, UV resistance, mold and mildew resistance, soundproofing, impact resistance, load carrying capacity, faster or slower expansion rates, insect resistance, conductivity, chemical resistance, pick-resistance and others known to those skilled in the art. For example, a sealant or coating having a rating or listing for Underwriters Laboratories 2079 may be applied to an impregnated compressed foam to create a fire resistant foam sealant.

One approach to addressing the shortcomings has been the creation of composite materials, where the foam core—whether solid or composed of laminations of the same or differing compositions—is coated or surface impregnated with a functional layer, so that the foam is merely a resilient backer for the sealant, intumescent or coating, such that the composition and density become less important. These coatings, and the associated properties, may be adhered to the surface of each layer of a core or layered thereon to provide multiple functional properties. As can be appreciated, the composite material may have different coatings applied the different sides to provide desired property or properties consistent with its position. Functional coatings such as a water-resistant sealant can protect the foam core from absorbing moisture even if the foam or foam impregnation is hydrophilic. Similarly, a functional coating such as a fire-rated sealant added to the foam core or lamination with protect a foam or foam impregnation that is flammable. A biocide may even be included. This could be layered, or on opposing surfaces, or—in the case of a laminate body—on perpendicular surfaces.

Additionally, it has become desirable, and in some situations required, for the joint sealant system to provide not only water resistance, but also fire resistance. A high degree of fire resistance in foams and impregnated foam sealants is well known in the art and has been a building code requirement for foam expansion joints in Europe for more than a decade. Fire ratings such as UL 2079, DIN 4102-2, BS 476, EN1399, AS1503.4 have been used to assess performance of expansion joint seals, as have other fire resistance tests and building codes and as the basis for further fire resistance assessments, the DIN 4102 standard, for example, is incorporated into the DIN 18542 standard for "Sealing of outside wall joints with impregnated sealing tapes made of cellular plastics—Impregnated sealing tapes". While each testing regime utilizes its own requirements for specimen preparation and tests (water test, hose stream tests, cycling tests), the 2008 version of UL 2079, the ISO 834, BS 476: Part 20, DIN 4102, and AS 1530.4-2005 use the Cellulosic time/temperature curve, based on the burning rate of materials found in general building materials and contents, which can be described by the equation $T=20+345*LOG(8*t+1)$, where t is time in minutes and T is temperature in C. While differing somewhat, each of these testing regimes addresses cycling and water resistance, as these are inherent in a fire resistant expansion joint. The fire resistance of a foam sealant or expansion has been sometimes partially or fully met by infusing, impregnating or otherwise putting into the foam a liquid-based fire retardant, such as aluminum trihydrate or other fire retardants commonly used to add fire resistance to foam. Unfortunately, this increases weight, alters the foam's compressibility, and may not provide the desired result without additional fire resistant coatings or additives if a binder, such as acrylic or polyurethane, is selected to treat the foam for fire and water resistance. Doing so while maintaining movement properties may affect the foam's compressibility at densities greater than 750 kg/m$^3$. Ultimately, these specialty impregnates and infused compositions increase product cost.

It has further become desirable or functionally required to apply a fire resistant coating to the foam joint systems to increase fire and water resistance, but often at the sacrifice of movement. Historically, fire-resistant foam sealant products that use an additional fire resistant surface coating to obtain the life safety fire properties have been limited to only +/−25% movement capability, especially when required to meet longer time-temperature requirements such as UL2079's 2 hour or longer testing. This +/−25% movement range is too limited for most movement joints and would not meet most seismic movement and expansion joint requirements. One well-known method for utilizing these low movement fire resistant joint sealants is to increase the width or size of the joint opening, an undesirable and expensive alternative, to allow for a commonly required +/−50% joint movement rating.

As can be appreciated, sealants, coatings, functional membranes, adhesives and other functional materials may be applied to or included, such as an adhesive to adhere the foam to the substrate. Where an adhesive is provided, the bond of the foam to the substrate can sometimes be weak, frustrating performance, due to the porous surface of the foam.

It would be an improvement to the art to provide an expansion joint seal which provided resistance to fire and water, retained compressibility over time, and did not require impregnating, infusing or compression forcing a large amount of solid fillers into the foam structure.

SUMMARY

The present disclosure therefore meets the above needs and overcomes one or more deficiencies in the prior art. The disclosure provides an expansion joint seal which includes a first body member made of a resiliently, elastically compressible material, a first flexible sheeting, a second body member made of a resiliently, elastically compressible material and a second flexible sheeting, where the first flexible sheeting is proximate the first body member bottom surface and in contact with the first body first side surface and the first body member second side surface and the second flexible sheeting is proximate the second body member top surface and in contact with the second body first side surface and the second body member second side surface and where the second body member width is equivalent to the first body member width and the first flexible sheeting is adjacent the second flexible sheeting.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

The present disclosure provides an expansion joint which may be used to seal against water penetration and to delay the penetration of flame through a structure.

Figure 1:
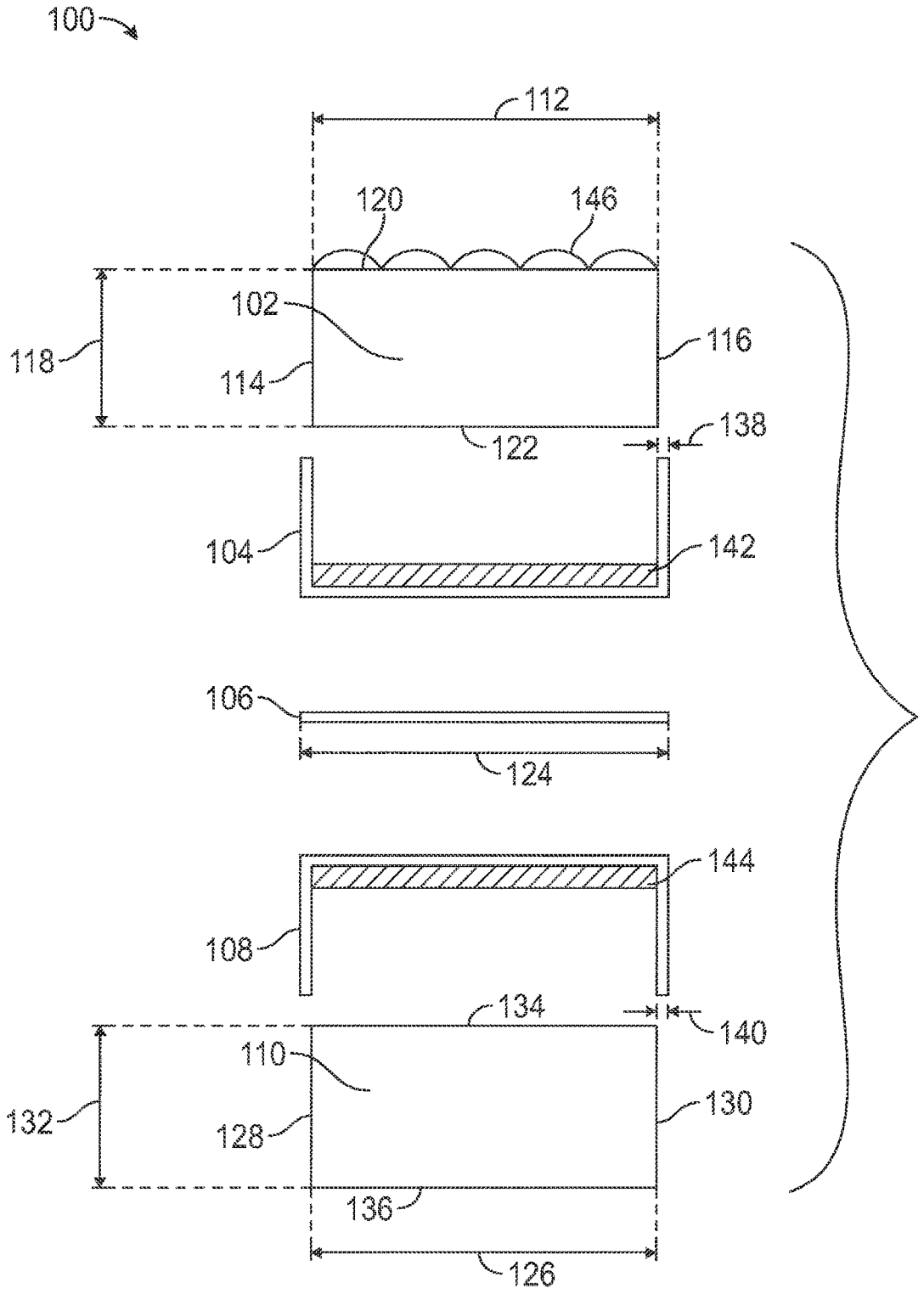
FIG. 1 illustrates an end view of an expansion joint seal according to the present disclosure.
Figure 2:
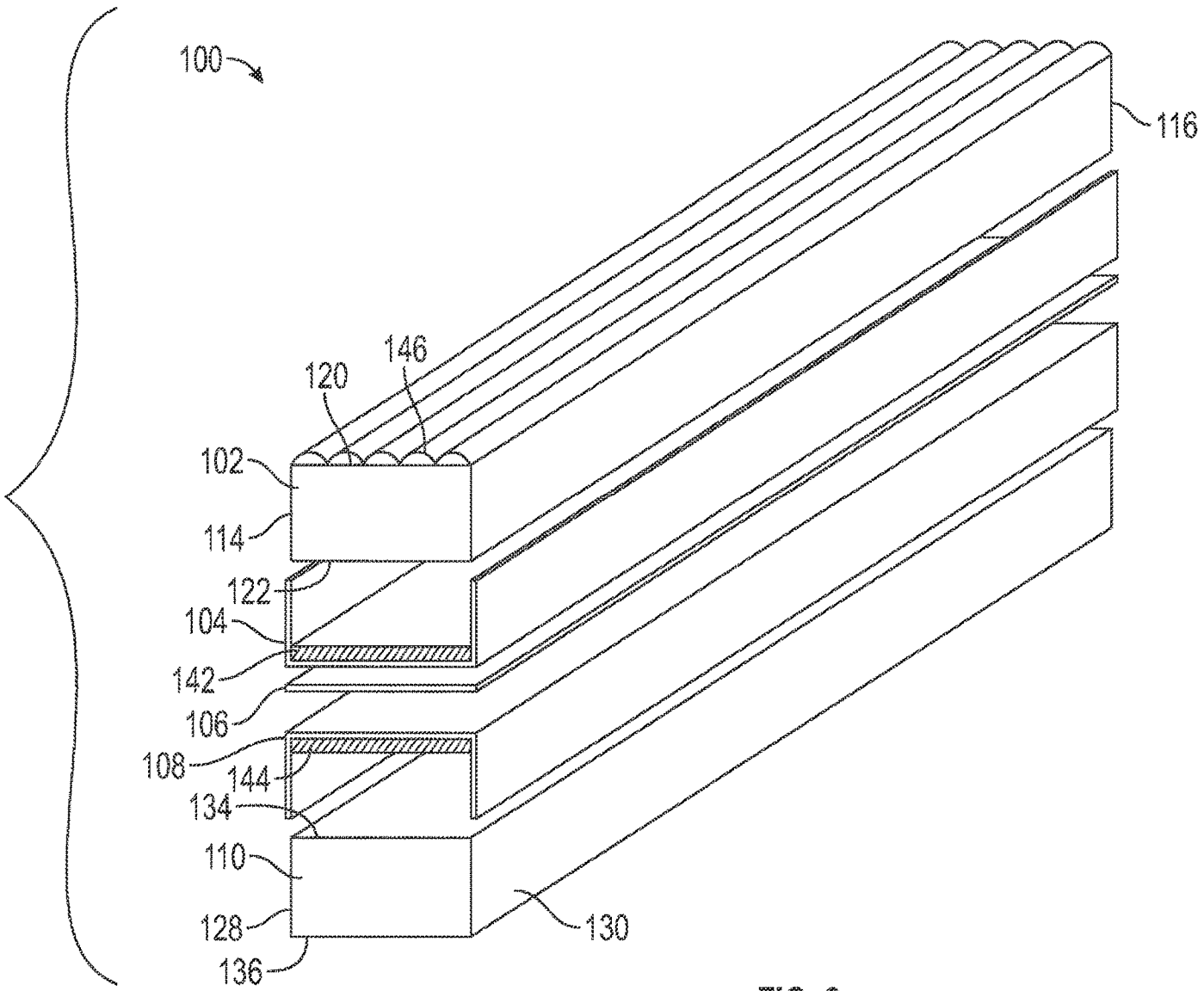
FIG. 2 illustrates an isometric view of the expansion joint seal according to the present disclosure.

Referring to FIGS. 1 and 2, end and isometric views of an expansion joint seal according to the present disclosure are provided. The expansion joint seal 100 includes a first body member 102, a first flexible sheeting 104, a second body member 110, and a second flexible sheeting 108.

The first body member 102 is preferably resiliently, elastically compressible. The body member 102 may be a foam member or may be a non-foam material which exhibits similar properties of compressibility, expansion, resiliency, and has the capacity to support liquid-based additives, such as fire retardants and fillers. The first body member 102 has a first body member width 112 between a first body member first side surface 114 and a first body member second side surface 116 and a first body member height 118 between a first body member top surface 120 and a first body member bottom surface 122. The first body member 102 is preferably a regular polygon in cross section. The first body member 102 may be generally rectangular in shape, through in cross section it may be any polygon, such as a trapezoid or square, so long as a generally long, flat surface is provided on its first body member bottom surface 122. The first body member 102 may have a first body member compressibility selected for its intended use and environment. The first body member 102 may be cut, formed or shaped to facilitate compression and/or increase the surface area for affixing the first flexible sheeting 104. The first flexible sheeting 104 or the first body member 102 may be longer than the other to facilitate sealant properties and provide an improved connection at joins, splices and transitions.

The first flexible sheeting 104 is positioned proximate the first body member bottom surface 122 and in contact with the first body first side surface 114 and the first body member second side surface 116. The first flexible sheeting 104 may alternatively be adjacent the first body member bottom surface 122. This first flexible sheeting 104 may be a plastic or metallic sheet, and may even be composed of other materials, such as ceramics or combinations thereof. The first flexible sheeting 104 provides a spring force to resist compression and provide expansion force to the expansion joint seal 100. This first flexible sheeting 104 may extend some portion, such as halfway or entirely, along the side of the first body first side surface 114 and/or the first body member second side surface 116, and may be adhered or bonded thereto, such as with an adhesive or chemically-active bond. This extending of the first flexible sheeting 104 may provide protection, sealing, and a surface for attachment to the adjacent substrate. Because the first flexible sheeting 104 has a first flexible sheeting thickness 138, the total width of the expansion joint seal 100 is at least the sum of twice this first flexible sheeting thickness 138 and the first body member width 112. The first flexible sheeting 104 may extend beyond the first body member top surface 120, providing a wing which may be connected to a nosing at the substrate or which may be adhered to or integrated with another material, such as a deck coating, a top of one of the adjacent substrates. The first flexible sheeting 104 may have a first flexible sheeting compressibility selected for its intended use and environment and consistent, though not necessarily equal to the first body member compressibility. The first flexible sheeting 104 may have an adhesive or other bonding agent on each surface to bond to the adjacent first body member 102 and/or the substrates of the expansion joint. The adhesive may be selected to provide additional properties such as water resistance or fire resistance. Further, the first flexible sheeting 104 may have a relaxed width less than the first body member width 112, requiring the first flexible sheeting 104 to be placed into tension before contact the first body member 102, placing the first body member 102 into compression prior to use.

The first flexible sheeting 104 may a continuous sheet, be overlapping or may be two internally unconnected pieces, such as two adjacent, but separated, pieces. The first flexible sheeting 104 may be vapor permeable, water resistant or waterproof, infrared reflecting, fire resistant, or provide other functional properties. Combinations, laminations or integration of more than one functional material into the first flexible sheeting 104 may be desirable.

The second body member 110 is preferably resiliently, elastically compressible and may be composed of the same material as the first body member 102. The second body member 110 has a second body member width 126 between a second body member first side surface 128 and a second body member second side surface 130 and a second body member height 132 between a second body member top surface 134 and a second body member bottom surface 136. The second body member width 126 is generally equivalent to the first body member width 112, but may be greater or less than depending on any difference in a second body member compressibility from the first body member compressibility. The second body member 110 is preferably a regular polygon in cross section. The second body member 110 may be generally rectangular in shape, through in cross section it may be any polygon, such as a trapezoid or square, provided a generally long, flat surface is provided on its second body member bottom surface 136. The second body member 110 may have a second body member compressibility selected for its intended use and environment, though not necessarily equal to the first body member compressibility or the first flexible sheeting compressibility. The second body member 110 may be cut, formed or shaped to facilitate compression and/or increase the surface area for affixing the second flexible sheeting 108. The second flexible sheeting 108 or the second body member 110 may be longer than the other to facilitate sealant properties and provide an improved connection at joins, splices and transitions.

The second flexible sheeting 108 is proximate the second body member top surface 134 and in contact with the second body first side surface 128 and the second body member second side surface 130. This second flexible sheeting 108 may be constructed of the same material as the first flexible sheeting 104, or may be a difference plastic or metallic sheet, and may even be composed of other materials, such as ceramics. The second flexible sheeting 108 likewise provides a spring force to resist compression and provide expansion force to the expansion joint seal 100. The second flexible sheeting 108 may extend the entirety of the side of one or both of the second body first side surface 128 and the second body member second side surface 130 and may be adhered or bonded thereto, such as with an adhesive or chemically-active bond. This extension may provide protection, sealing, and a surface for attachment to the adjacent substrate. The second flexible sheeting 108 may extend beyond the second body member bottom surface 134, providing a further surface for connection. The second flexible sheeting 108 may have a second flexible sheeting compressibility selected for its intended use and environment and consistent, though not necessarily equal to the compressibility of any other component. Because the second flexible sheeting 108 has a second flexible sheeting thickness 140, the total width of the expansion joint seal 100 is at least the sum of twice this second flexible sheeting thickness 140 and the second body member width 126. The second flexible sheeting 108 may have an adhesive or other bonding agent on each surface to bond to the adjacent second body member 110 and/or the substrates of the expansion joint. Further, the second flexible sheeting 108 may have a relaxed width less than the second body member width 126, requiring the second flexible sheeting 108 to be placed into tension before contact the second body member 110, placing the second body member 110 into compression prior to use.

The second flexible sheeting 108 may a continuous sheet, be over lapping or be two internally unconnected pieces, such as two adjacent, but separated, pieces. The second flexible sheeting 108 may be vapor permeable, water resistant or waterproof, infrared reflecting, fire resistant, or provide other functional properties. Combinations, laminations or integration of more than one functional material into the second flexible sheeting 108 may be desirable.

Once assembled, the first flexible sheeting 104 is adjacent the second flexible sheeting 108 in the expansion joint seal 100. In the absence of any intermediate body, the first flexible sheeting 104 may be adhered or bonded to the second flexible sheeting 108, or the first flexible sheeting 104 and second flexible sheeting 108 may be formed of a single extruded piece.

The first flexible sheeting 104 and/or the second flexible sheeting 108 may be constructed or be composed of materials to provide mechanical and performance benefits. This may include materials which are vapor-impermeable, have vapor low permeability, provide fire retardancy, are intumescent, are hydrophilic, or are hydrophobic. Selection of the rigidity and compressibility of the first flexible sheeting 104 and/or the second flexible sheeting 108 may also be a consideration to provide a spring force for the expansion joint seal 100 to resist compression and avoid any compression set of the first body member 102 and the second body member 110. Preferably, first flexible sheeting 104 and/or the second flexible sheeting 108 is selected of a material to provide protection to the substrate and to the first body member 102 and/or the second body member 110.

When desired, the first body member 102 and/or the second body member 110 may be composed of a foam or other material, such as an open cell foam, a lamination of open cell foam and close cell foam, and closed cell foam. Any of various types of foam known in the art may be selected for first body member 102 and/or the second body member 110, including compositions such as polyurethane and polystyrene, and may be open or closed cell. The uncompressed density of the first body member 102 and/or the second body member 110 may also be altered for performance, depending on local weather conditions. Because first body member 102 and/or the second body member 110 may be composed of a plurality of layers, more than one composition may be selected for the various foam members, such that one layer of the first body member 102 and/or the second body member 110 has a mechanical property or composition different from the balance of the layers. A lamination with other layers may be provided, such as by elements adhered together to provide desired mechanical and/or functional characteristics and may comprise multiple glands and/or rigid layers that collapse under seismic loads. One or more of the layers, for example, may be selected of a composition which is fire retardant or water resistant.

When desired, the expansion joint seal 100 may be assembled or supplied in a continuous length to reduce or eliminate field splices.

The first body member 102 and/or the second body member 110 may be of polyurethane foam and may be open celled foam or closed cell. A combination of open and closed cell foams may alternatively be used. The first body member 102 and/or the second body member 110 may contain hydrophilic, hydrophobic or fire-retardant compositions as impregnates, or as surface infusions, as vacuum infusion, as injections, full or partial, or combinations of them. Each of the first body member 102 and/or the second body member 110 may be made to include, such as by impregnation or infusion, a sintering material, wherein the particles in the impregnate move past one another with minimal effort at ambient temperature but form a solid upon heating. Once such sintering material is clay or a nano-clay. Such a sintering impregnate would provide an increased overall insulation value and permit a lower density at installation than conventional foams while still having a fire endurance capacity of at least one hour, such as in connection with the UL 2079 standard for horizontal and vertical joints. While the cell structure, particularly, but not solely, when compressed, of the first body member 102 and/or the second body member 110 preferably inhibits the flow of water, the presence of an inhabitant or a fire retardant may prove additionally beneficial. The fire retardant may be introduced as part of the foaming process, or by impregnating, coating, infusing, or laminating, or by other processes known in the art.

Further, when desired, the first body member 102 and/or the second body member 110 may have a treatment, such as impregnation, to increase desirable properties, such as fire resistance or water resistance, by, respectively, the introduction of a fire retardant into the foam or the introduction of a water inhibitor into the foam. Further, the first body member 102 and/or the second body member 110 may be composed of a hydrophilic material, a hydrophobic material, a fire-retardant material, or a sintering material.

Moreover, the first body member 102 and/or the second body member 110 may be selected from partially closed cell or viscoelastic foams. Most prior art foams seals have been designed as "soft foam" pre-compressed foam seals utilizing low to medium density foam (about 16-30 kg/m$^3$) and softer foam (ILD range of about 10-20). It has been surprisingly found through extensive testing of variations of foam densities and foam hardness, fillers and elastic impregnation compounds that higher density "hard" foams with high ILD's can provide an effective foam seal meeting the required waterproofing (600 Pa minimum and ideally 1000 Pa or greater) and movement and cycling requirements such as ASTM E-1399 Standard Test Method for Cyclic Movement and Measuring the Minimum and Maximum Joint Widths of Architectural Joint Systems as well as long term joint cycling testing. An advantage has been found in using higher density and higher hardness (higher ILD) foams particularly in horizontal applications. While at first this might seem obvious it is known in the art that higher density foams that are about 32-50 kg/m$^3$ with an ILD rating of about 40 and greater tend to have other undesirable properties such as a long term decrease in fatigue resistance. Desirable properties such as elongation, ability to resist compression set, foam resiliency and fatigue resistance typically decline relative to an increase in density and ILD. These undesirable characteristics are often more pronounced when fillers such as calcium carbonate, melamine and others are utilized to increase the foam density yet the cost advantage of the filled foam is beneficial and desirable. Similarly, when graft polyols are used in the manufacture of the base foam to increase the hardness or load carrying capabilities, other desirable characteristics of the base foam such as resiliency and resistance to compression set can be diminished. Through the testing of non-conventional impregnation binders and elastomers for pre-compressed foam sealants such as silicones, urethanes, polyureas, epoxies, and the like, it has been found that materials that have reduced tack or adhesive properties after cure and which provide a high internal recovery force can be used to counteract the long-term fatigue resistance of the high density, high ILD foams. Further, it has been found that by first impregnating and curing the foam with the injected or impregnated silicone, acrylic, urethane or other low tack polymers and, ideally, elastomers with about 100-200% elongation or greater providing a sufficient internal recovery force, that it was additionally advantageous to re-impregnate the foam with another elastomer or binder to provide a timed expansion recovery at specific temperatures. The impregnation materials with higher long-term recovery capabilities imparted to the high density, high ILD base foams, such as a silicone or urethane elastomers, can be used to impart color to the foam seal or be a clear or translucent color to retain the base foam color. If desirable a second impregnation, partial impregnation or coating can be applied to or into the foam seal to add additional functional characteristics such as UV stability, mold and mildew resistance, color, fire-resistance or fire-ratings or other properties deemed desirable to functionality to the foam.

Viscoelastic foams have not typically been commercially available or used for foam seals due to perceived shortcomings. Commonly used formulations, ratios and methods do not provide a commercially viable foam seal using viscoelastic foam when compared to standard polyurethane foams. Open cell viscoelastic foams are more expensive than polyester or polyether polyurethane foams commonly used in foam seals. Any impregnation process on a viscoelastic foam tends to proceed slower than on a traditional foam due to the fine cell structure of viscoelastic foam. This can be particularly frustrating as the impregnation materials and the impregnation process are typically the most expensive component of a foam seal. However, because of their higher initial density viscoelastic foams can provide better load carrying or pressure resistant foam seal. Both properties are desirable but not fully provided for in the current art for use in applications such as load carrying horizontal joints or expansion joints for secondary containment. Common densities found in viscoelastic foams are 64-80 kg/m$^3$ or greater. Additionally, viscoelastic foams have four functional properties (density, ILD rating, temperature and time) compared to flexible polyurethane foams, which have two primary properties (density and an ILD rating).

However, the speed of recovery of viscoelastic foams following compression may be increased by reducing or eliminating any impregnation, surface impregnation or low adhesive strength impregnation compound. Incorporating fillers into the impregnation compound is known to be effective in controlling the adhesive strength of the impregnation binder and therefore the re-expansion rate of the impregnated foam. By surface impregnating or coating the outside surface of one or both sides of viscoelastic foam to approximately 10% of the foam thickness, such as about 3-8 mm deep for conventional joint seals, the release time can be controlled and predicted based on ambient temperature. Alternatively, the foam can be infused, partially impregnated or impregnated with a functional or non-functional filler without a using binder but rather only a solvent or water as the impregnation carrier where the carrier evaporates leaving only the filler in the foam.

The re-expansion rate of a seal using viscoelastic foam may be controlled by using un-impregnated viscoelastic foam strips and re-adhering them with a pressure sensitive adhesive or hot melt adhesive. When the seal is compressed, the laminating adhesive serves as a temporary restriction to re-expansion allowing time to install the foam seal. Viscoelastic foam may be advantageously used, rather than standard polyurethane foam, for joints requiring additional softness and flexibility due to higher foam seal compression in hot climates or exposure or increased stiffness in cold temperatures when a foam seal is at its minimum compressed density. Additionally, closed cell, partially closed cell and other foams can be used as in combination with the viscoelastic foams to reduce the overall cost.

Because of the relative softness and ease of compressibility of medium density viscoelastic foams, they may be used in seals allowing for easy hand compression and installation at the job site. Such a seal would not require factory compression before delivery, reducing manufacturing costs and the expense of the packaging material needed to maintain compression. The first body member 102 could be formed of commercially available vapor permeable foam products or by forming specialty foams. Commercial available products which provide vapor permeable and excellent fire resistant properties are well known, such as Sealtite VP or Willseal 600. It is well known that a vapor permeable but water resistant foam joint sealant may be produced leaving at least a portion of the cell structure open while in compression such that water vapor can escape through the impregnated foam sealant. Water is then ejected on the exterior of a body member 102 because the foam, and/or any impregnation, is hydrophobic and therefore repels water. Water can escape from the foam sealant or wall cavity through water vapor pressure by virtue of the difference in humidity creating unequal pressure between the two areas. Because the cell structure is still partially open the vapor pressure drive is sufficient to allow moisture to return to equalization or the exterior of the structure. By a combination of compression ratio and impregnation density of a hydrophobic component the water resistance capacity can be increased to provide resistance to various levels of pressure or driving rain.

This second group of body materials, the non-foam members, may include, for example, corrugated cardboards, natural and man-made batting materials, and natural, synthetic and man-made sponge material. When desired, such materials may be selected for properties, such as water leakage, air leakage, resilience in face of one or more cycling regimes, compressibility, relaxation rate, compression set, and elasticity.

Additionally, the first body member 102 and/or the second body member 110 may be altered to provide additional functional characteristics. The first body member 102 and/or the second body member 110 may be infused, impregnated, partially impregnated or coated with an impregnation material or binder that is designed specifically to provide state of the art seal water-resistance properties with a uniform and consistent distribution of the waterproofing binder. The first body member 102 and/or the second body member 110 may also, or alternatively, be infused or impregnated or otherwise altered to retain a fire retardant, dependent on function. Where a first body member 102 and/or the second body member 110 is foam, any suitable open cell foam type with a density of 16-45 kg/m$^3$ or higher can provide an effective water-resistant foam-based seal by varying the impregnation density or the final compression ratio. Where a sound resistant seal is desired, the density or the variable densities provide a sound resistant seal in a similarly-rated wall from a Sound Transmission Class value from 42-63 and/or a sound reduction between 12 and 50 decibels.

One or more of the first body member 102 and/or the second body member 110 may be selected from an inherently hydrophilic material or have a hydrophilic component such as a hydrophilic polymer that is uniformly distributed throughout the material of the first body member 102 and/or the second body member 110. The first body member 102 and/or the second body member 110 may include strategically-placed surface impregnation or partially impregnate with a hydroactive polymer. Because the primary function of the first body member 102 and/or the second body member 110 is waterproofing, rather than fire-resistance, the addition of a hydrophilic function does not negatively impact the fire-resistant properties, as an increased moisture content in the first body member 102 and/or the second body member 110 may increase fire resistive properties.

Upon installation in an expansion joint, the first body member 102 and/or the second body member 110 remain in compression. Over time, as the distance between the substrates changes, such as during heating and during cooling, the first body member 102 and/or the second body member 110 expand to fill the void of the expansion joint or is compressed to fill the void of the expansion joint. Prior to installation, the first body member 102 and/or the second body member 110 may be relaxed or pre-compressed. Therefore, the first body member 102 and/or the second body member 110 prior to compression is wider than the nominal size of the expansion joint. When the first body member 102 and/or the second body member 110 is imposed between the first substrate and the second substrate, the first body member 102 and/or the second body member 110 is maintained in compression in the joint, and, by virtue of its nature, inhibits the transmission of water or other contaminants further into the expansion joint.

Each of the first body member 102 and/or the second body member 110 is sized to provide a first body member width 112 and a second body member width 126, respectively, of sufficient width to provide the water resistance function.

The first body member 102 and/or the second body member 110 may be selected to provide a lower density at installation, whether by a low uncompressed density or a lower compression ratio, thereby providing a spring force. The first body member 102 and/or the second body member 110 therefore accommodate lateral compression caused by fluctuation of the distance between the substrates, the joint width.

When desired, the expansion joint seal 100 may further include a third body member 106, to provide preferred mechanical and functional properties. The third body member 106 has a third body member width 124, which does not the expansion joint seal width, as provided above as a function of the first body member 102 and first flexible sheeting 104 or of the second body member 110 and the second flexible sheeting 108. The third body member 106 is positioned between and in contact with the first flexible sheeting 104 and the second flexible sheeting 108 and is adhered or bonded to each. While the first body member 102 and the first flexible sheeting 104 generally have equal or equivalent lengths and while the second body member 110 and the second flexible sheeting 108 generally have equal or equivalent lengths, the third body member 106 may have a shorter length, and may be structured with a plurality of third body members 106, like ribs, encapsulated or positioned between the first flexible sheeting 104 and the second flexible sheeting 108.

When desired, the third body member 106 may selected of materials to provide other benefits. The third body member 106 may contain on a sintering material, a thermally-insulating material, a hydrophilic material, a hydrophobic material, a refractory material, an intumescing material, a fire retardant, or a metal oxide.

Additionally, when desired, the expansion joint system 100 may include a first interior member 142 to provide mechanical and/or functional benefits. The first interior member 142 may be a solid block, or a number of blocks, or a flexible enclosure, such as a sealed container of compounds, or a layer. When a solid block or sealed container is used, there is no any infusion or impregnation of the first body member 102 of the constituents of the solid block or flexible enclosure. The first interior member 142 is positioned intermediate the first body member 102 and the first flexible sheeting 104 and may be adhered or bonded to each and may, contain a sintering material, a thermally-insulating material, a hydrophilic material, a hydrophobic material, a refractory material, an intumescing material, a fire retardant, a metal oxide.

Similarly, when desired, the expansion joint system 100 may include a second interior member 144 to provide mechanical and/or functional benefits. The second interior member 142 may be a solid block, or a number of blocks, or a flexible enclosure, such as a sealed container of compounds, or a layer. When a solid block or sealed container is used, there is no infusion or impregnation of the second body member 110 of the constituents of the solid block or flexible enclosure. The second interior member 144 is positioned intermediate the second body member 110 and the second flexible sheeting 108 and may be adhered or bonded to each and may contain a sintering material, a thermally-insulating material, a hydrophilic material, a hydrophobic material, a refractory material, an intumescing material, a fire retardant, a metal oxide.

The reaction of the third body member 106 to heat may be selected for desired temperature to select the temperature at which the third body member 106 ceases providing structural support and begin reacting to provide fire protection. Temperature selection may be desirable to address high pressure water incidents as opposed to fire events. As a result of temperature selection and fire retardant properties of the third body member 106, the body member 102 need not include a fire retardant. When the third body member 106 expands upon exposure to fire, the joint is afforded some protection against fire damage. When the third body member 106 is intumescent, it expands upon exposure to the selected temperature, providing a wider cross section of intumescent expansion and protective crusting over the expansion joint seal 100.

The expansion joint seal 100 may therefore have the capability to provide the movement and able to meet cycling requirements.

The first body member 102, the third body member 106, and the second body member 110 may be selected for depth as to the extent of protection needed.

The present disclosure may avoid the first body member 102 and/or the second body member 110 taking a compression set, such as during a hot summer, so that when the substrates separate in cold weather, the first body member 102 and/or the second body member 110 has lost resiliency and fails instead of expanding to fill the increased joint size.

The first flexible sheeting 104 and the second flexible sheeting 108 may have sufficient spring force to retard such a condition.

A layer 146, which may provide fire resistant and/or water resistance and may be an elastomer, may be applied across the first body member top surface 120 of the expansion joint seal 100. The layer 146 may be an intumescent or a fire-retarding elastomer, such as Dow Corning 790. The first body member top surface 120 may be coated or partially coated with a flexible or semi-rigid elastomer to increase load carrying capability. These, or other coatings, may be used to provide waterproofing, fire resistance, or additional functional benefits. The layer 146 may provide a redundant sealant and may be on the side of a laminate of the body member 102. The layer 146 may be particularly beneficial in connection with use of a body member 102 which is not impregnated or only slightly impregnated, so that the layer 146 may provide a primary sealant, protecting the body member 102 from moisture or increasing its resiliency. The layer 146 may be a hydrophilic polymer, a flexible elastomer or antimicrobial coating.

Preferably, expansion joint seal 100 provides sufficient protection to the substrates 506, 508 such the expansion joint seal 100 may pass a modified Rijkswaterstaat (RWS) test that protects against extreme initial temperature exposure within the first 12 minutes or meet the requirements of a full RWS or Underwriters Laboratories (UL) 1709 for a one-hour time-temperature exposure or greater. The UL 1709 test, for example, is largely a horizontal line at a temperature of 2000° F. regardless of time.

Other variations may be employed. The expansion joint seal 100 may be constructed to withstand a hydrostatic pressure equal to or greater than 29.39 psi. Environmentally friendly, recycled, biodegradable and renewable foam, fillers, binders, elastomer and other components may be selected to meet environmental, green and energy efficiency standards. The body member 102 may exhibit auxetic properties to provide support or stability for the expansion joint seal 100 as it thermally cycles or to provide additional transfer loading capacity. Auxetic properties may be provided by the body material, the internal components such as the members/membrane or by an external mechanical mechanism. The body member 102 may have a rigid or semi-rigid central core equal to 5-65% of the first body member width 112. The body member 102 may have a central core rigid through normal joint cycling, typically +/−25%, but collapsible under seismic (+/−50%) joint cycling. Such as body member 102 having a central core both rigid and collapsible may be part of a data feedback system where sensors collect data and supplies information to be stored internally or externally.

Additionally, when desired, a sensor may be included and may contact one of more of the first body member 102, the third body member 106, the second body member 110, first flexible sheeting 104, and second flexible sheeting 108, as well as any other component included in the expansion joint seal 100. The sensor may be a radio frequency identification device, commonly known as RFID, or other wirelessly transmitting/receiving sensor. A sensor may be beneficial to assess the health of an expansion joint seal 100 without accessing the interior of the expansion joint, otherwise accomplished by removal of the cover plate. Such sensors are known in the art, and which may provide identification of circumstances such as moisture penetration and accumulation. The inclusion of a sensor in the expansion joint seal 100 may be particularly advantageous in circumstances where the expansion joint seal 100 is concealed after installation, particularly as moisture sources and penetration may not be visually detected. Thus, by including a low cost, moisture-activated or sensitive sensor, the user can scan the expansion joint seal 100 for any points of weakness due to water penetration. A heat sensitive sensor may also be positioned within the expansion joint seal 100, thus permitting identification of actual internal temperature, or identification of temperature conditions requiring attention, such as increased temperature due to the presence of fire, external to the joint or even behind it, such as within a wall. Such data may be particularly beneficial in roof and below grade installations where water penetration is to be detected as soon as possible.

Inclusion of a sensor in the expansion joint seal 100 may provide substantial benefit for information feedback and potentially activating alarms or other functions within the expansion joint seal 100 or external systems. Fires that start in curtain walls are catastrophic. High and low-pressure changes have deleterious effects on the long-term structure and the connecting features. Providing real time feedback and potential for data collection from sensors, particularly given the inexpensive cost of such sensors, in those areas and particularly where the wind, rain and pressure will have their greatest impact would provide benefit. While the pressure on the wall is difficult to measure, for example, the deflection in a pre-compressed sealant is quite rapid and linear. Additionally, joint seals are used in interior structures including but not limited to bio-safety and cleanrooms. Additionally, a sensor could be selected which would provide details pertinent to the state of the Leadership in Energy and Environmental Design, often referred to as LEED, efficiency of the building. Additionally, such a sensor, which could identify and transmit air pressure differential data, could be used in connection with masonry wall designs that have cavity walls or in the curtain wall application, where the air pressure differential inside the cavity wall or behind the cavity wall is critical to maintaining the function of the system. A sensor may be positioned in other locations within the expansion joint seal 100 to provide beneficial data. A sensor may be positioned within the body member 102 at, or near, the top 404 to provide prompt notice of detection of heat outside typical operating parameters, so as to indicate potential fire or safety issues. Such a positioning would be advantageous in horizontal of confined areas. A sensor so positioned might alternatively be selected to provide moisture penetration data, beneficial in cases of failure or conditions beyond design parameters. The sensor may provide data on moisture content, heat or temperature, moisture penetration, and manufacturing details. A sensor may provide notice of exposure from the surface of the expansion joint seal 100 most distant from the base of the joint. A sensor may further provide real time data. Using a moisture sensitive sensor in the expansion joint seal 100 and at critical junctions/connections would allow for active feedback on the waterproofing performance of the expansion joint seal 100. It can also allow for routine verification of the watertightness with a hand-held sensor reader to find leaks before the reach occupied space and to find the source of an existing leak. Often water appears in a location much different than it originates making it difficult to isolate the area causing the leak. A positive reading from the sensor alerts the property owner to the exact location(s) that have water penetration without or before destructive means of finding the source. The use of a sensor in the expansion joint seal 100 is not limited to identifying water intrusion but also fire, heat loss, air loss, break in joint continuity and other functions that cannot be checked by non-destructive means. Use of a sensor within expansion joint seal 100 may provide a benefit over the prior art. Impregnated foam materials, which may be used for the expansion joint seal 100, are known to cure fastest at exposed surfaces, encapsulating moisture remaining inside the body, and creating difficulties in permitting the removal of moisture from within the body. While heating is a known method to addressing these differences in the natural rate of cooling, it unfortunately may cause degradation of the foam in response. Similarly, while forcing air through the foam bodies may be used to address the curing issues, the potential random cell size and structure impedes airflow and impedes predictable results. Addressing the variation in curing is desirable as variations affect quality and performance properties. The use of a sensor within expansion joint seal 100 may permit use of the heating method while minimizing negative effects. The data from the sensors, such as real-time feedback from the heat, moisture and air pressure sensors, aids in production of a consistent product. Moisture and heat sensitive sensors aid in determining and/or maintaining optimal impregnation densities, airflow properties of the foam during the curing cycle of the foam impregnation. Placement of the sensors into foam at the pre-determined different levels allows for optimum curing allowing for real time changes to temperature, speed and airflow resulting in increased production rates, product quality and traceability of the input variables to that are used to accommodate environmental and raw material changes for each product lots.

The selection of components providing resiliency, compressibility, water-resistance and fire resistance, the expansion joint seal 100 may be constructed to provide sufficient characteristics to obtain fire certification under any of the many standards available. In the United States, these include ASTM International's E 814 and its parallel Underwriter Laboratories UL 1479 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multistory Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E-84, UL 94, ASTM E 136 "Behavior of Materials in a Vertical Tube Furnace at 750° C." (Combustibility), ASTM E 2178, Air Barrier Association of America (ABAA) air permeability compliance, International Energy Conservation Code (IECC) 2009 ASTM E 1399 "Tests for Cyclic Movement of Joints," ASTM E 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG(8*t+1) where t is time, in minutes, and T is temperature in degrees Celsius including E 814/UL 1479 and E 1966/UL 2079.

E 814/UL 1479 tests a fire retardant system for fire exposure, temperature change, and resilience and structural integrity after fire exposure (the latter is generally identified as "the Hose Stream test"). Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1479 listing, it must pass both the fire endurance (F rating) and the Hose Stream test. The temperature data is only relevant where building codes require the T to equal the F-rating.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire resistant system. The Hose Stream uses a stream of water. The stream is to be delivered through a 64 mm hose and discharged through a National Standard playpipe of corresponding size equipped with a 29 mm discharge tip of the standard-taper, smooth-bore pattern without a shoulder at the orifice consistent with a fixed set of requirements:

| Hourly Fire Rating Time in Minutes | Water Pressure (kPa) | Duration of Hose Stream Test (sec./m$^2$) |
|---|---|---|
| 240 ≤ time < 480 | 310 | 32 |
| 120 ≤ time < 240 | 210 | 16 |
| 90 ≤ time < 120 | 210 | 9.7 |
| time < 90 | 210 | 6.5 |

The nozzle orifice is to be 6.1 meters from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 meters by an amount equal to 305 millimeter for each 10° of deviation from the normal. Some test systems, including UL 1479 and UL 2079 also provide for air leakage and water leakage tests, where the rating is made in conjunction with a L and W standard. These further ratings, while optional, are intended to better identify the performance of the system under fire conditions.

When desired, the Air Leakage Test, which produces an L rating and which represents the measure of air leakage through a system prior to fire endurance testing, may be conducted. The L rating is not pass/fail, but rather merely a system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Nonhardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72-hour assessment.

Another frequently encountered classification is ASTM E-84 (also found as UL 723 and NFPA 255), Surface Burning Characteristics of Burning Materials. A surface burn test identifies the flame spread and smoke development within the classification system. The lower a rating classification, the better fire protection afforded by the system. These classifications are determined as follows:

| Classification | Flame Spread | Smoke Development |
|---|---|---|
| A | 0-25 | 0-450 |
| B | 26-75 | 0-450 |
| C | 76-200 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall (head-of-wall) joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification (if used) | Minimum number of cycles | Minimum cycling rate (cycles per minute) | Joint Type (if used) |
|---|---|---|---|
| No Classification | 0 | 0 | Static |
| Class I | 500 | 1 | Thermal Expansion/Contraction |
| Class II | 500 | 10 | Wind Sway |
| Class III | 100 | 30 | Seismic |
| | 400 | 10 | Combination |

ASTM E 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated.

The expansion joint seal 100 may therefore perform wherein the bottom surface 804 at a maximum joint width increases no more than 181° C. after sixty minutes when the body member 102 is exposed to heating according to the equation T=20+345*LOG(8*t+1), where t may be time in minutes and T may be temperature in C.

The expansion joint seal 100 may also perform wherein the bottom surface 136 of the second body member 110, having a maximum joint width of more than six (6) inches, increases no more than 139° C. after sixty minutes when the expansion joint seal 100 is exposed to heating according to the equation T=20+345*LOG(8*t+1), where t may be time in minutes and T may be temperature in C.

Similarly, the bottom surface 136 of the second body member 110 at a maximum joint width increases no more than 181° C. after sixty minutes when the joint seal is exposed to heating according to the equation T=20+345*LOG(8*t+1), where t is time in minutes and T is temperature in C.

The expansion joint seal 100 may be adapted to be cycled one of 500 times at 1 cycle per minute, 500 times at 10 cycles per minute and 100 cycles at 30 times per minute, without indication of stress, deformation or fatigue.

In other embodiments, the expansion joint seal 100 configured to pass hurricane force testing to TAS 202/203. Further the expansion joint seal 100 may be designed or configured to pass ASTM E-282, E-331, E-330, E-547 or similar testing to meet the pressure cycling and water resistance requirements up to 5000 Pa or more.

As can be appreciated, the foregoing disclosure may incorporate or be incorporated into other expansion joint systems, such as those with fire retardant members in a side of the first body member 102 and/or second body member 110 adjacent the substrate, the inclusion of a separate barrier within the first body member 102 and/or second body member 110 and which may extend beyond the first body member 102 and/or second body member 110 or remain encapsulated within, one or more longitudinal load transfer members atop or within a the first body member 102 and/or second body member 110, without or without support members, a cover plate, a spline or ribs tied to the cover plate whether fixedly or detachably, use of auxetic materials, or constructed to obtain a fire endurance rating or approval according to any of the tests known in the United States and Europe for use with expansion joint systems, including fire endurance, movement classification(s), load bearing capacity, air penetration and water penetration.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

What is claimed is:

1. An expansion joint seal, comprising:

a first body member, the first body member being resiliently, elastically compressible, the first body member having a first body member width between a first body member first side surface and a first body member second side surface and a first body member height between a first body member top surface and a first body member bottom surface, the first body member being a foam;

a first flexible sheeting, the first flexible sheeting proximate the first body member bottom surface and in contact with the first body member first side surface and the first body member second side surface, the first flexible sheeting having one or more properties selected from the group of vapor-impermeable, vapor low permeability, fire retardancy, intumescent, hydrophilic, and hydrophobic, the first flexible sheeting adhered to the first body member first side surface at least halfway from the first body member bottom surface to the first body member top surface, and the first flexible sheeting adhered to the first body member second side surface at least halfway from the first body member bottom surface to the first body member top surface, and the first flexible sheeting having a first flexible sheeting thickness;

a second body member, the second body member being resiliently, elastically compressible, the second body member having a second body member width between a second body member first side surface and a second body member second side surface and a second body member height between a second body member top surface and a second body member bottom surface, the second body member being a foam, the second body member width equivalent to the first body member width;

a second flexible sheeting, the second flexible sheeting proximate the second body member top surface and in contact with the second body member first side surface and the second body member second side surface, the second flexible sheeting having one or more properties selected from the group of vapor-impermeable, vapor low permeability, fire retardancy, intumescent, hydrophilic, and hydrophobic, the second flexible sheeting adhered to the second body member first side surface at least halfway from the second body member bottom surface to the second body member top surface, and the second flexible sheeting adhered to the second body member second side surface at least halfway from the second body member bottom surface to the second body member top surface, and the second flexible sheeting having a second flexible sheeting thickness, the first flexible sheeting adjacent the second flexible sheeting;

the first flexible sheeting not contacting a second body member first side surface and the first flexible sheeting not contacting a second body member second side surface;

a third body member, the third body member having a third body member width, the third body member width not exceeding the greater of the one of the sum of the first body member width and twice the first flexible sheeting thickness and the sum of of the second body member width and twice the second flexible sheeting thickness, the third body member intermediate the first flexible sheeting and the second flexible sheeting, the third body member adhered to the first flexible sheeting and adhered to the second flexible sheeting; and a first interior member intermediate the first body member and the first flexible sheeting, the first interior member selected from one of a flexible enclosure and a solid body, the first interior member containing one or more materials selected from the group consisting of a sintering material, a thermally-insulating material, a hydrophilic material, a hydrophobic material, a refractory material, an intumescing material, a fire retardant, a metal oxide.

2. The expansion joint seal of claim 1, wherein the third body member contains one or more materials selected from the group consisting of a sintering material, a thermally-insulating material, a hydrophilic material, a hydrophobic material, a refractory material, an intumescing material, a fire retardant, a metal oxide and wherein the third body member having a maximum joint width of more than six inches and wherein the third body member is adapted so a bottom surface temperature of a bottom of the third body member increases no more than 139° C. after sixty minutes when the joint seal is exposed to heating according to the equation T=20+345*LOG(8*t+1), where t is time in minutes and T is temperature in C and wherein the third body member is adapted so a bottom surface temperature of a bottom of the third body member at a maximum joint width increases no more than 181° C. after sixty minutes when the joint seal is exposed to heating according to the equation T=20+345*LOG(8*t+1), where t is time in minutes and T is temperature in C.

3. The expansion joint seal of claim 1, further comprising a second interior member intermediate the second body member and the second flexible sheeting, the second interior member selected from one of a flexible enclosure and a solid body, the second interior member containing one or more materials selected from the group consisting of a sintering material, a thermally-insulating material, a hydrophilic material, a hydrophobic material, a refractory material, an intumescing material, a fire retardant, a metal oxide.

4. The expansion joint seal of claim 1, wherein the third body member having a maximum joint width of more than six inches and wherein the third body member is adapted so a bottom surface temperature of a bottom of the third body member increases no more than 139° C. after sixty minutes when the joint seal is exposed to heating according to the equation T=20+345*LOG(8*t+1), where t is time in minutes and T is temperature in C.

5. The expansion joint seal of claim 1, wherein the third body member is adapted so a bottom surface temperature of a bottom of the third body member at a maximum joint width increases no more than 181° C. after sixty minutes when the joint seal is exposed to heating according to the equation T=20+345*LOG(8*t+1), where t is time in minutes and T is temperature in C.

6. The expansion joint seal of claim 4, wherein the joint seal is adapted to be cycled one of 500 times at 1 cycle per minute, 500 times at 10 cycles per minute and 100 cycles at 30 times per minute, without indication of stress, deformation or fatigue.

* * * * *